US009572407B2

(12) United States Patent
Ng

(10) Patent No.: US 9,572,407 B2
(45) Date of Patent: Feb. 21, 2017

(54) JEWELRY CLASP

(71) Applicant: Pak Hei Ng, N.T. (HK)

(72) Inventor: Pak Hei Ng, N.T. (HK)

( * ) Notice: Subject to any disclaimer, the term of this patent is extended or adjusted under 35 U.S.C. 154(b) by 22 days.

(21) Appl. No.: 14/819,449

(22) Filed: Aug. 6, 2015

(65) Prior Publication Data

US 2016/0058135 A1 Mar. 3, 2016

(30) Foreign Application Priority Data

Aug. 28, 2014 (CN) ..... 2014 1 0432818

(51) Int. Cl.
*A44C 5/20* (2006.01)

(52) U.S. Cl.
CPC ..... *A44C 5/2066* (2013.01); *A44C 5/2076* (2013.01); *A44D 2203/00* (2013.01)

(58) Field of Classification Search
CPC .. A44D 2203/00; A44C 5/2066; A44C 5/2076
See application file for complete search history.

(56) References Cited

U.S. PATENT DOCUMENTS

| | | | | |
|---|---|---|---|---|
| 7,523,527 | B2 * | 4/2009 | Garber | A44C 5/2061 24/303 |
| 9,089,193 | B2 * | 7/2015 | Casini | A44C 5/2071 |
| 2005/0198788 | A1 * | 9/2005 | Costa | A44C 5/20 24/303 |
| 2008/0047111 | A1 * | 2/2008 | Garber | A44C 5/2061 24/303 |
| 2014/0000068 | A1 * | 1/2014 | Casini | A44C 5/2071 24/303 |

* cited by examiner

*Primary Examiner* — Robert J Sandy

(57) ABSTRACT

A jewelry clasp having a male connector, a female connector, a locking sleeve, chain connectors and locking cylinders. The chain connectors are connected to outer end surfaces of the male connector and the female connector. The locking cylinders are sleeved onto outer ends of the male connector and the female connector. Positioning locking devices which allow the chain connectors, the male connector and the female connector to be connected together are provided between the locking cylinders and the chain connectors. The female connector is sleeved into one end of the locking sleeve, and a locking device is provided between the female connector and the locking sleeve. The male connector is sleeved into another end of the locking sleeve; an inner end of the male connector is coupled with an inner end of the female connector; another locking device is provided between the male connector and the locking sleeve.

10 Claims, 10 Drawing Sheets

JEWELRY CLASP

BACKGROUND OF THE INVENTION

The present invention relates to a jewelry clasp, and more particularly to a jewelry clasp device or mechanism connecting and securing two ends of a jewelry chain.

At present, most jewelry chains (including hand chains and necklaces) in the market comprise a chain, a male connector and a female connector. The connections between one end of the chain and the male connector and between another end of the chain and the female connector are fixed, securing the male connector and the female connector together so that the chain forms a closed loop. This type of jewelry chain mainly has the following disadvantages: First, the two ends of the chain are fixedly connected with the male connector component and the female connector component respectively, and the connection is completed by the manufacturers before product release; consumers cannot disassemble freely; also, consumers cannot change the color of the clasp device or the style of the chain according to their personal tastes and outfits matching needs in order to develop personalized style trends. Second, the clasp structure of the male connector and the female connector is completely exposed, so that it is easily chafed against other objects and detached when user is putting on the jewelry chain, resulting in unsecure locking and easy detachment. Third, as the clasp structure of the male connector and the female connector is completely exposed, the appearance of the jewelry chain is largely affected. Fourth, the male connector and the female connector only have one type of color and shape, and can only follow the original color of the jewelry chain; consumers can only accept a jewelry chain in the color predetermined by the manufacturers before product release; consumers cannot change the colour and shape of the clasp according to personal tastes and outfits matching needs to develop personalized style trends. In view of the aforesaid disadvantages now present in the prior art, it is essential to redevelop and redesign the connective structure of this part.

BRIEF SUMMARY OF THE INVENTION

An object of the present invention is to provide a jewelry chain clasp which has the advantages of secure locking, secure connection, being impossible to detach accidentally, convenient to lock, convenient to disassemble and assemble, simple and aesthetic in appearance, convenient for consumers to freely mix and match, simple in structure, and highly reliable and durable.

To achieve this, the present invention adopts the following technical proposal: A jewelry clasp comprising a male connector, a female connector, a locking sleeve, chain connectors and locking cylinders, wherein the chain connectors are connected to outer end surfaces of the male connector and the female connector. The locking cylinders are sleeved onto outer ends of the male connector and the female connector. Positioning locking means which allow the chain connectors, the male connector and the female connector to be reliably connected together are provided between the locking cylinders and the chain connectors. The female connector is sleeved into one end of the locking sleeve, and a locking means is provided between the female connector and the locking sleeve. The male connector is sleeved into another end of the locking sleeve; an inner end of the male connector is coupled with an inner end of the female connector; a locking means is provided between the male connector and the locking sleeve. Rotation of the locking sleeve once enables the locking means at two ends of the locking sleeve to reliably and securely lock and couple the male connector and the female connector together.

Furthermore, the outer end surfaces of male connector and the female connector are each provided with a coupling cavity, and the chain connectors are sleeved into the coupling cavities.

Furthermore, the positioning locking means for reliably coupling the chain connectors, the male connector and the female connector may have two embodiments, namely: First, the chain connectors each has an outer appearance of a specific shape which is identical to a shape of each of the coupling cavities; an outer end surface of each of the locking cylinders is provided with a positioning opening for passage of the chain connector. An outer surface of each of the locking cylinders is further provided with an elongated hole, and the pins enter from the elongated holes to be secured on the male connector and the female connector respectively to enable the locking cylinders to be sleeved onto the male connector and the female connector respectively. Rotation of the locking cylinders once causes the chain connectors and the positioning openings to offset with each other to position and lock the chain connectors in the coupling cavities. Second, the chain connectors each has an outer appearance of a specific shape which is identical to a shape of each of the coupling cavities; a shaft is provided on an outer surface of each of the chain connectors; the locking cylinders are each provided with a locking slot and an elongated hole; the coupling cavities of the male connector and the female connector each has a groove at a cavity wall thereof; the pins enter from the elongated holes to be secured on the male connector and the female connector respectively to enable the locking cylinders to be sleeved onto the male connector and the female connector respectively; the shafts embed into the grooves and the locking slots respectively; rotation of the locking cylinders once causes locking of the shafts and the locking slots to position and lock the chain connectors into the coupling cavities.

Furthermore, the locking means for reliably coupling the locking sleeve, the male connector and the female connector may have two embodiments, namely: First, the locking sleeve is provided with a locking slot in an inner wall at each of two ends of the locking sleeve; the pins secured at the male connector and the female connector respectively have a length exceeding thickness of the locking cylinders; the male connector is provided with a coupling portion; the female connector is provided with a coupling portion receiving cavity; the coupling portion of the male connector and the coupling portion receiving cavity of the female connector are coupled together; top ends of the pins are embedded in the locking slots; rotation of the locking sleeve once enables the pins and the locking slots to lock with each other to reliably and securely lock and couple the male connector and the female connector together. Second, the locking sleeve is provided with a locking slot in an inner wall at one end of the locking sleeve, an inner wall at another end of the locking sleeve is provided with a positioning flange; the male connector is provided with a coupling portion, and a positioning annular groove is provided on the coupling portion; the female connector is provided with a coupling portion receiving cavity; the pin secured at the female connector has a length exceeding thickness of the locking cylinder; the coupling portion of the male connector passes through the positioning flange to couple with the coupling portion receiving cavity of the female connector; the positioning annular groove on the coupling portion embeds with the positioning flange; a top end of the pin at the female connector is embedded in the locking slot; rotation of the locking sleeve once enables the pin and the locking slot to lock with each other and the positioning annular groove and the positioning flange to be embedded in offset, thereby reliably and securely locking and coupling the male connector and the female connector together.

The present invention has the following beneficial effects: (1) when in use, the chain connectors are responsible for connecting the chain of the jewelry chain, the positioning locking means between the locking cylinders and the male connector and the female connector couples the male connector and the female connector together, and the locking sleeve and the locking means couple the male connector and the female connector together. The entire assembly details of the present invention are concealed inside the locking sleeve, and thus the aesthetics and neat appearance of the jewelry chain would not be affected. Only the outer appearance of the locking sleeve can be seen from outside. It is therefore neat, aesthetically pleasing and delicate. (2) The locking cylinders securely and safely lock the chain connectors and the male connector and the female connector, and the locking sleeve also securely and safely locks the male connector and the female connector, so that the jewelry chain would not detach accidentally when worn, and would not detach itself due to accidental contact of the internal locking structure. (3) The entire structure of the present invention does not require screws or tools for disassembling and assembling, so that when consumers use the jewelry chain, they can easily change the styles of the jewelry chain or switch to locking sleeves of different styles according to styling and adornment needs. It helps consumers to develop personalized style trends. Besides, this design also facilitates jewelry manufacturers to provide locking sleeves of different colors and styles for matching with each jewelry chain products, so as to facilitate consumers to switch between locking sleeves of different colors according to personal tastes and outfits matching needs, thus fulfilling consumers' needs for styling and adornment. (4) The components of the present invention achieves assembly and connection by their structures, thus there is no need for any tools during assembly of the jewelry chain. It has the advantages of being simple in structure, highly reliable and durable, convenient to lock and convenient to assemble.

DETAILED DESCRIPTION OF THE INVENTION

Figure 1:
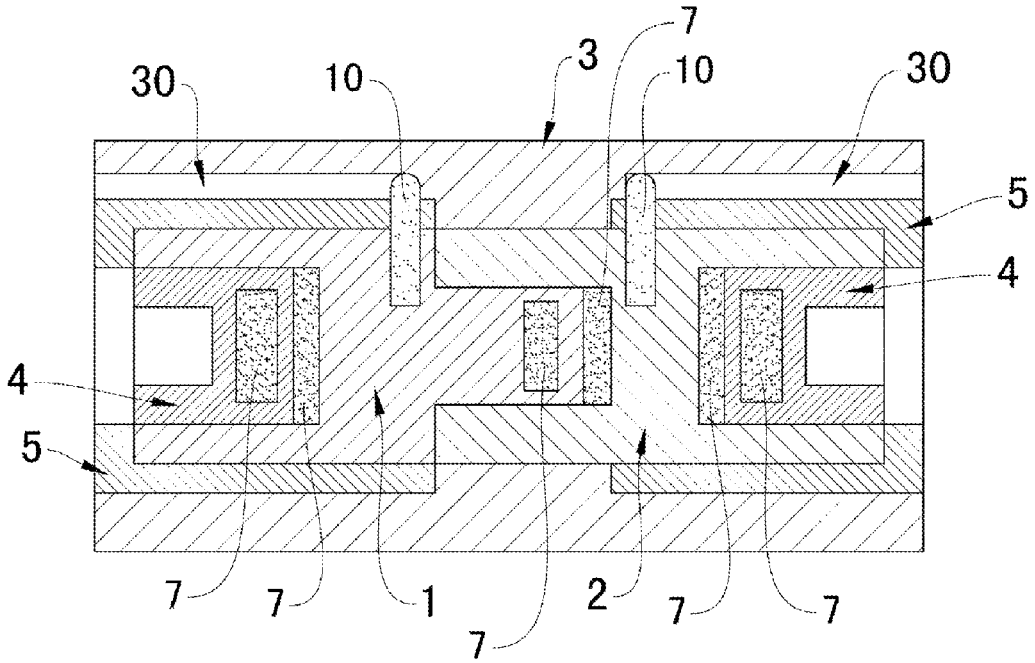
FIG. 1 illustrates a sectional structural view of a first embodiment of the present invention.

As shown in FIGS. 1, 2, 9 and 14, the jewelry clasp of the present invention comprises a male connector 1, a female connector 2, a locking sleeve 3, chain connectors 4 and locking cylinders 5.

The chain connectors 4 are connected to outer end surfaces of the male connector 1 and the female connector 2. The locking cylinders 5 are sleeved onto outer ends of the male connector 1 and the female connector 2. Positioning locking means which allow the chain connectors 4, the male connector 1 and the female connector 2 to be reliably connected together are provided between the locking cylinders 5 and the chain connectors 4.

The female connector 2 is sleeved into one end of the locking sleeve 3, and a locking means is provided between the female connector 2 and the locking sleeve 3. The male connector 1 is sleeved into another end of the locking sleeve 3; an inner end of the male connector 1 is coupled with an inner end of the female connector 2; a locking means is provided between the male connector 1 and the locking sleeve 3. Rotation of the locking sleeve once enables the locking means at two ends of the locking sleeve 3 to reliably and securely lock and couple the male connector 1 and the female connector 2 together.

Figure 2:
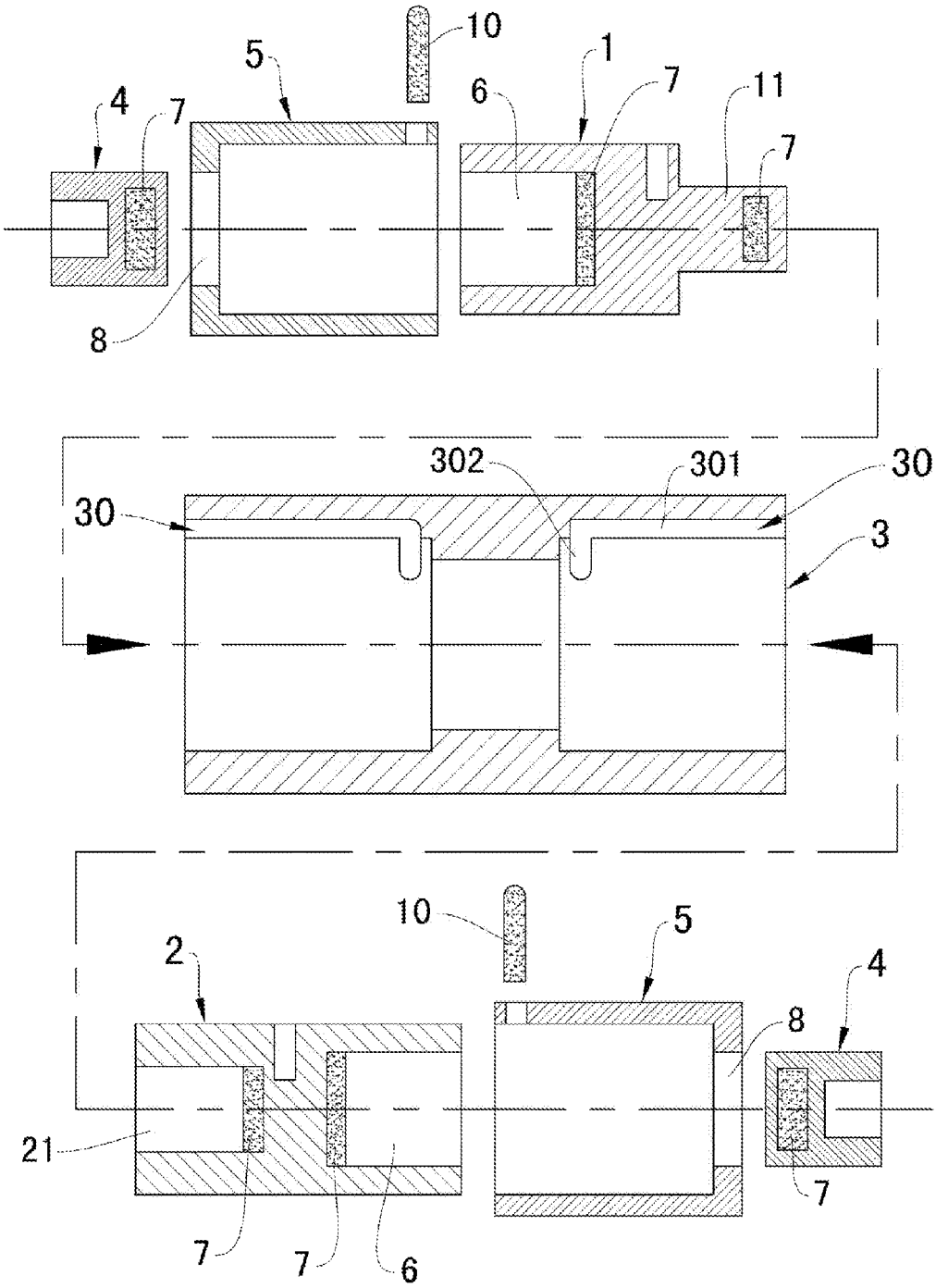
FIG. 2 illustrates a sectional structural view of the present invention as shown in FIG. 1 after disassembling.
Figure 3:
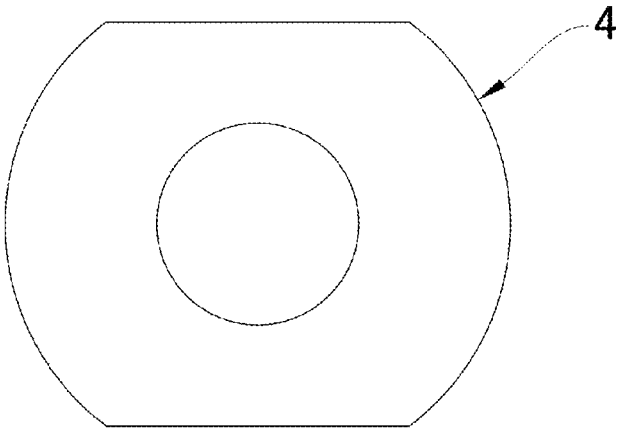
FIG. 3 illustrates a left structural view of the chain connector of the first embodiment of the present invention.
Figure 4:
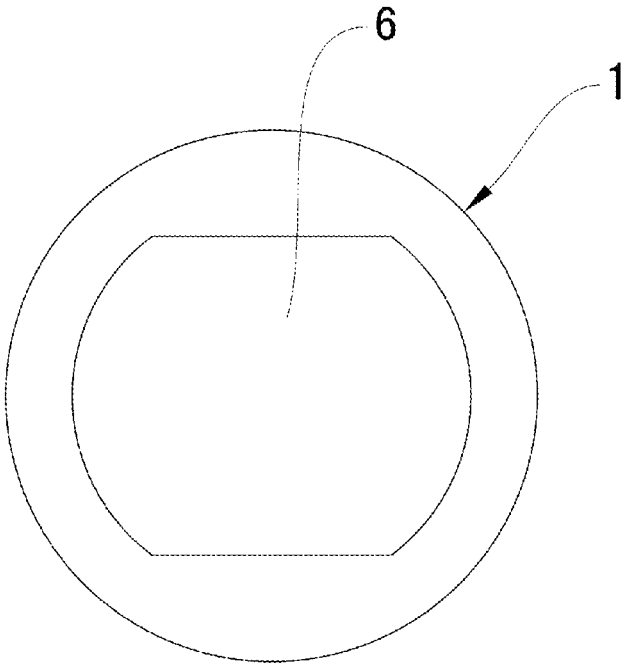
FIG. 4 illustrates a left structural view of the male connector of the first embodiment of the present invention.
Figure 5:
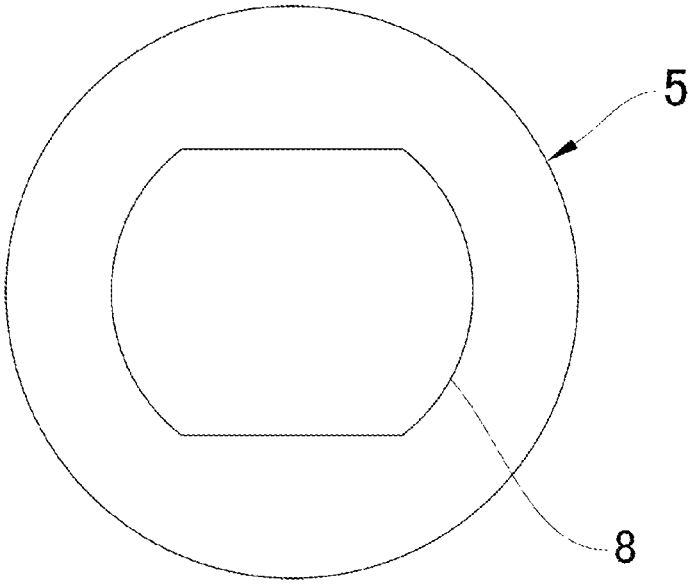
FIG. 5 illustrates a left structural view of the locking cylinder of the first embodiment of the present invention.
Figure 6:
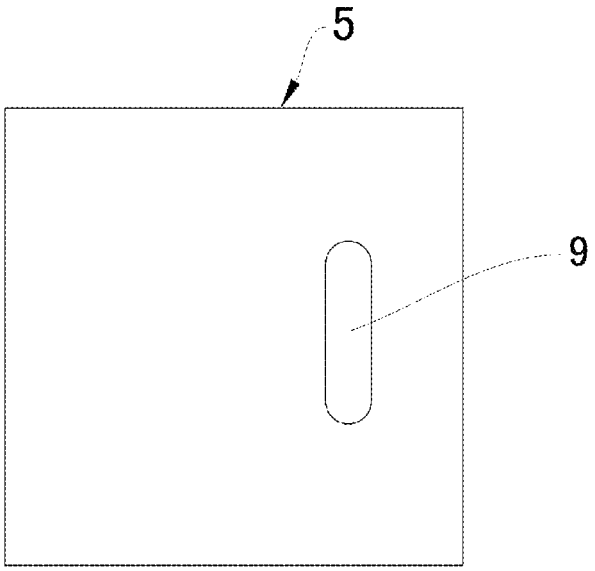
FIG. 6 illustrates a top structural view of the locking cylinder of the first embodiment of the present invention.
Figure 7:
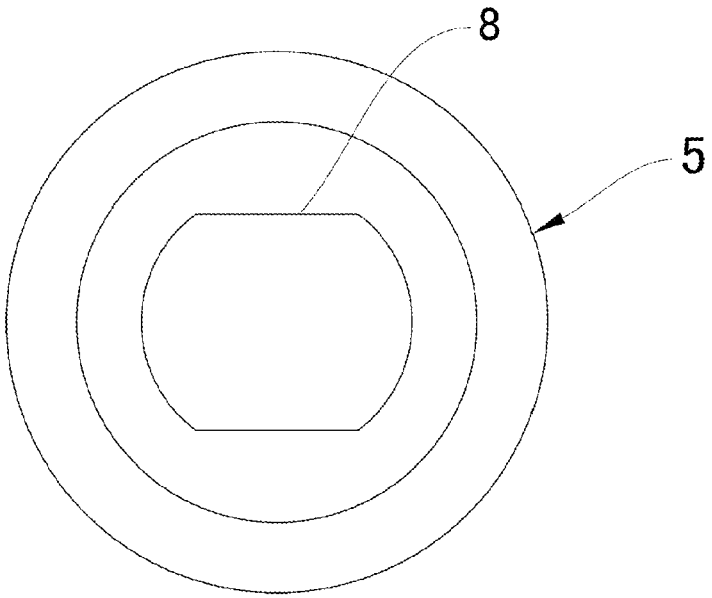
FIG. 7 illustrates a right structural view of the locking cylinder of the first embodiment of the present invention.

To facilitate the assembly of the chain connectors 4, the male connector 1 and the female connector 2, as shown in FIGS. 2 and 4, the outer end surfaces of male connector 1 and the female connector 2 are each provided with a coupling cavity 6, and the chain connectors 4 are sleeved into the coupling cavities 6. Besides, to prevent the chain connectors 4 from spinning freely in the coupling cavities 6 after assembly of the chain connectors 4, as shown in FIG. 3, the chain connectors 4 each has an outer appearance of a specific shape, and the coupling cavities 6 each has a cavity wall in a shape which correspondingly couples with the shape of the chain connector, so that the chain connectors 4 cannot spin freely in the coupling cavities 6 after assembly, so as to cooperate with the locking cylinders 5 for positioning and locking.

Besides, to facilitate the alignment of the chain connectors 4 and the coupling cavities 6 and to allow the chain connectors 4 to sleeve into the coupling cavities 6 more conveniently and rapidly, as shown in FIGS. 1 and 2, the chain connectors 4 are embedded with magnetic blocks 7, and the coupling cavities 6 are embedded with magnetic blocks 7 at bottoms thereof. In general, the magnetic blocks 7 of the chain connectors 4 and the magnetic blocks 7 of the coupling cavities 6 have opposite polarities to achieve attraction of the opposites.

The positioning locking means among the locking cylinders 5, the chain connectors 4, the male connector 1 and the female connector 2 may have two embodiments during implementation, namely:

First, as shown in FIGS. 1 and 2, as mentioned above, the chain connectors 4 each has an outer appearance of a specific shape which is identical to a shape of each of the coupling cavities 6 to facilitate positioning of the chain connectors in the coupling cavities 6 and prevent free spinning. An outer end surface of each of the locking cylinders 5 is provided with a positioning opening 8 for passage of the chain connector 4. An outer surface of each of the locking cylinders 5 is further provided with an elongated hole 9 for a pin 10 to pass through, and the pins 10 are secured on the male connector 1 and the female connector 2 respectively to enable the locking cylinders 5 to be sleeved onto the male connector 1 and the female connector 2 respectively. Rotation of the locking cylinders 5 once causes the chain connectors 4 and the positioning openings 8 to offset with each other to position and lock the chain connectors 4 in the coupling cavities 6. The elongated holes 9 mainly provide a moving area for the pins 10 so that the locking cylinders 5 only rotate within a predefined angle defined by the area defined by the elongated holes 9.

Figure 14:
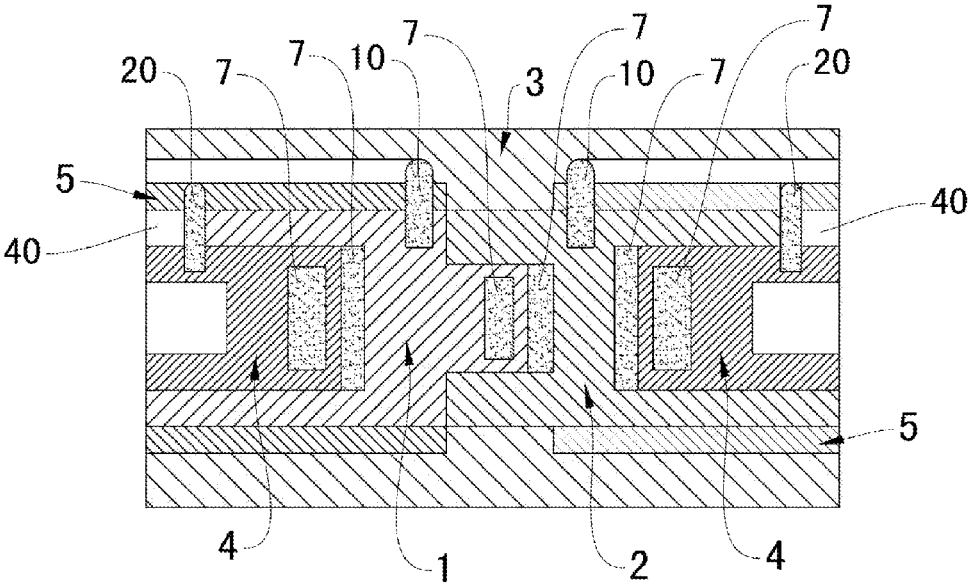
FIG. 14 illustrates a sectional structural view of a third embodiment of the present invention.
Figure 15:
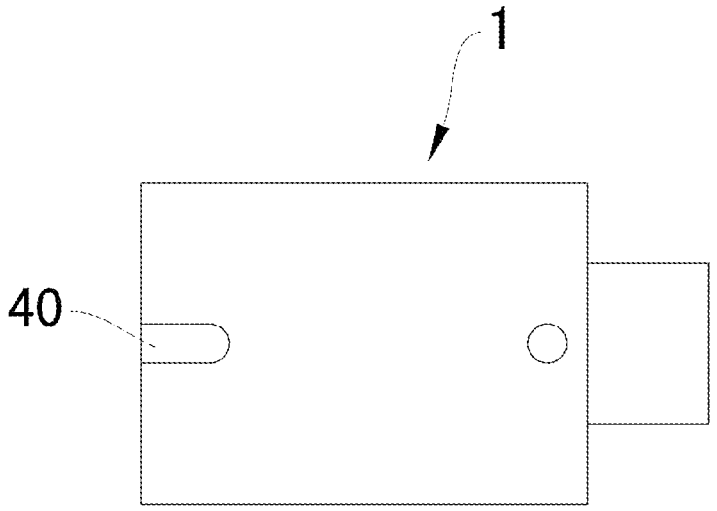
FIG. 15 illustrates a top structural view of the male connector of the third embodiment of the present invention.
Figure 16:
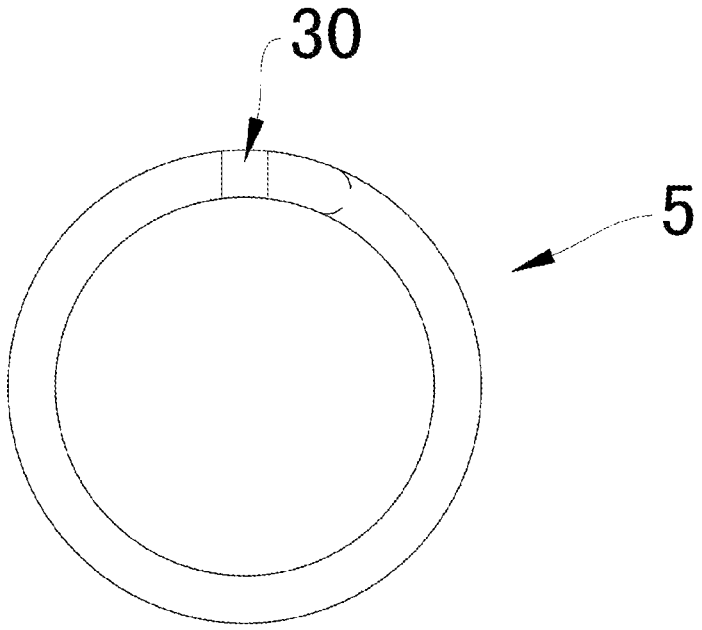
FIG. 16 illustrates a left structural view of the locking cylinder of the third embodiment of the present invention.
Figure 17:
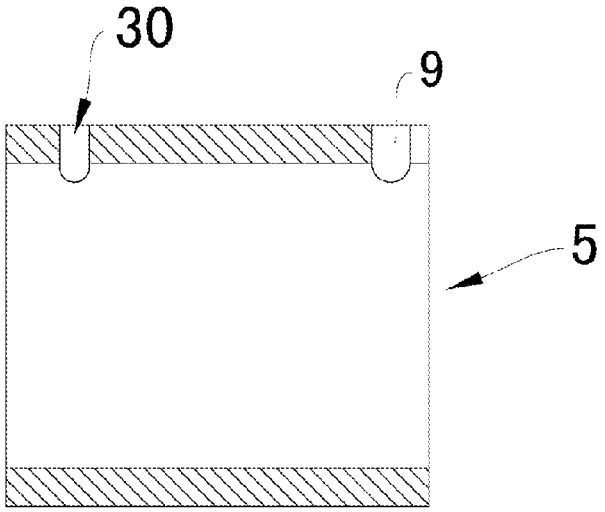
FIG. 17 illustrates a sectional structural view of the locking cylinder of the third embodiment of the present invention.
Figure 18:
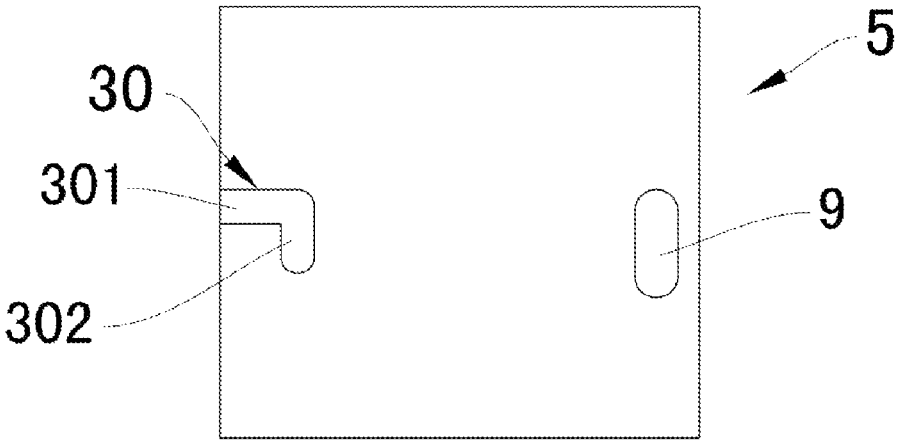
FIG. 18 illustrates a top structural view of the locking cylinder of the third embodiment of the present invention.

Second, as shown in FIGS. 14 to 18, similar to the aforementioned, the chain connectors 4 each has an outer appearance of a specific shape which is identical to a shape of each of the coupling cavities 6. A shaft 20 is provided on an outer surface of each of the chain connectors 4. The locking cylinders 5 are each provided with a locking slot 30 and an elongated hole 9. As shown in FIGS. 15 and 14, the coupling cavities 6 of the male connector 1 and the female connector 2 each has a groove 40 at a cavity wall thereof. The grooves 40 are mainly used for allowing the shafts 20 to enter the locking slots 30. The pins 10 enter from the elongated holes 9 to be secured on the male connector 1 and the female connector 2 respectively to enable the locking cylinders 5 to be sleeved onto the male connector 1 and the female connector 2 respectively. As the chain connectors 4 are sleeved into the male connector 1 and the female connector 2 respectively, the shafts 20 embed into the grooves 40 and the locking slots 30 respectively. Rotation of the locking cylinders 5 once causes locking of the shafts 20 and the locking slots 30 to position and lock the chain connectors 4 into the coupling cavities 6.

Figure 8:
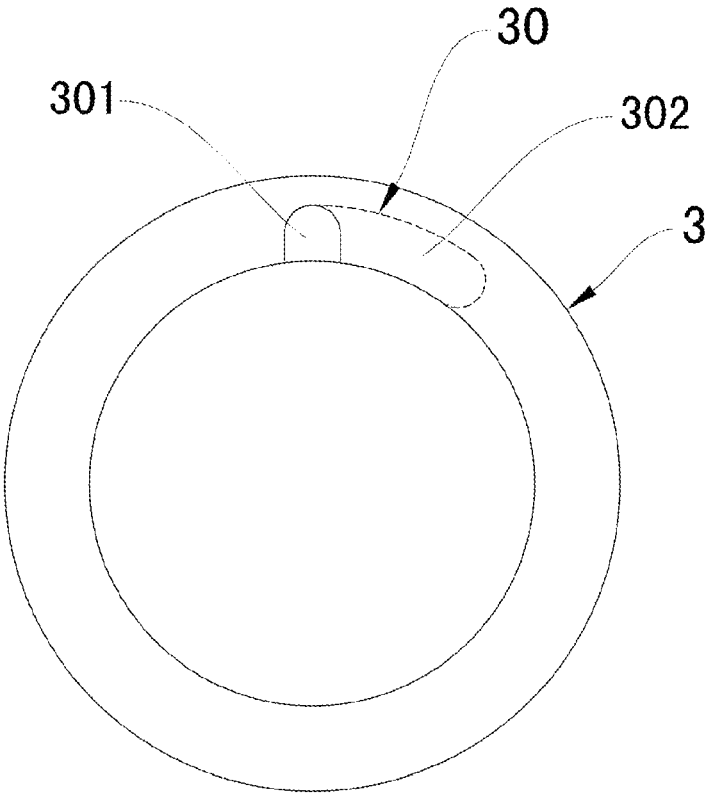
FIG. 8 illustrates a left structural view of the locking sleeve of the first embodiment of the present invention.

The locking means among the female connector 2, the male connector 1 and the locking sleeve 3 may have two embodiments during implementation, namely:

First, as shown in FIGS. 1, 2 and 8, the locking sleeve 3 is provided with a locking slot 30 in an inner wall at each of two ends of the locking sleeve 3. The pins 10 secured at the male connector 1 and the female connector 2 respectively have a length exceeding thickness of the locking cylinders 5, so that the pins 10 also serve as a locking means to lock with the locking slots 30 respectively, or the pins 10 also serve as positioning means of the locking cylinders 5 and the locking sleeve 3. The male connector 1 is provided with a coupling portion 11. The female connector 2 is provided with a coupling portion receiving cavity 21. The coupling portion 11 of the male connector 1 and the coupling portion receiving cavity 21 of the female connector 2 are coupled together. Top ends of the pins 10 are embedded in the locking slots 30. Rotation of the locking sleeve 3 once enables the pins 10 and the locking slots 30 to lock with each other to reliably and securely lock and couple the male connector 1 and the female connector 2 together.

Second, as shown in FIGS. 9 to 13, the locking sleeve 3 is provided with a locking slot 30 in an inner wall at one end of the locking sleeve 3, an inner wall at another end of the locking sleeve 3 is provided with a positioning flange 31. The male connector 1 is provided with a coupling portion 11, and a positioning annular groove 12 is provided on the coupling portion 11. The female connector 2 is provided with a coupling portion receiving cavity 21. The pin 10 secured at the female connector 2 has a length exceeding thickness of the locking cylinder 5. The coupling portion 11 of the male connector 1 passes through the positioning flange 31 to couple with the coupling portion receiving cavity 21 of the female connector 2. The positioning annular groove 12 on the coupling portion 11 embeds with the positioning flange 31. A top end of the pin 10 at the female connector 2 is embedded in the locking slot 30. Rotation of the locking sleeve 3 once enables the pin 10 and the locking slot 30 to lock with each other and the positioning annular groove 12 and the positioning flange 31 to be embedded in offset, thereby reliably and securely locking and coupling the male connector 1 and the female connector 2 together.

Figure 9:
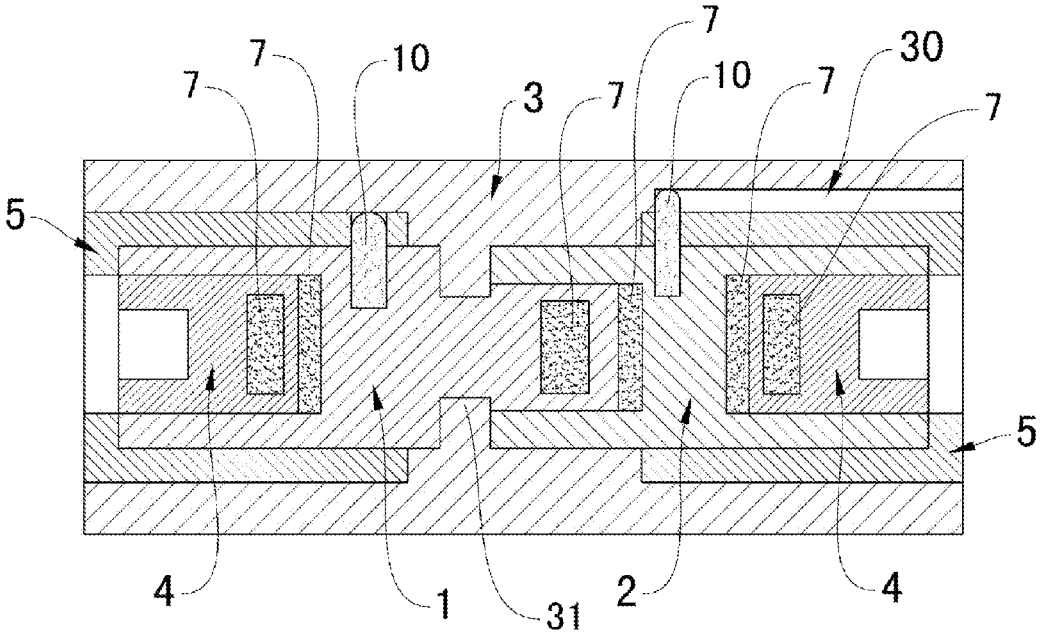
FIG. 9 illustrates a sectional structural view of a second embodiment of the present invention.
Figure 10:
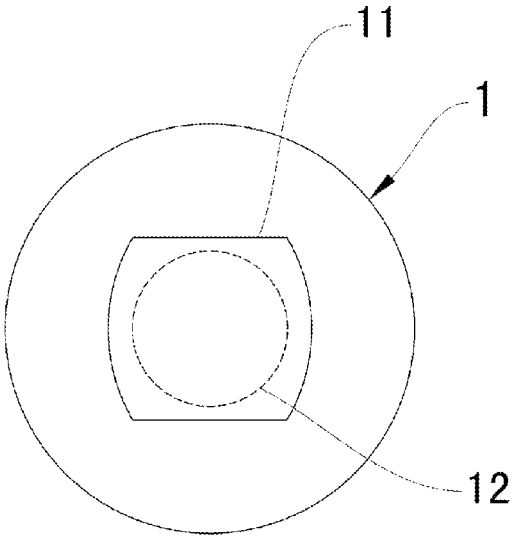
FIG. 10 illustrates a right structural view of the male connector of the second embodiment of the present invention.
Figure 11:
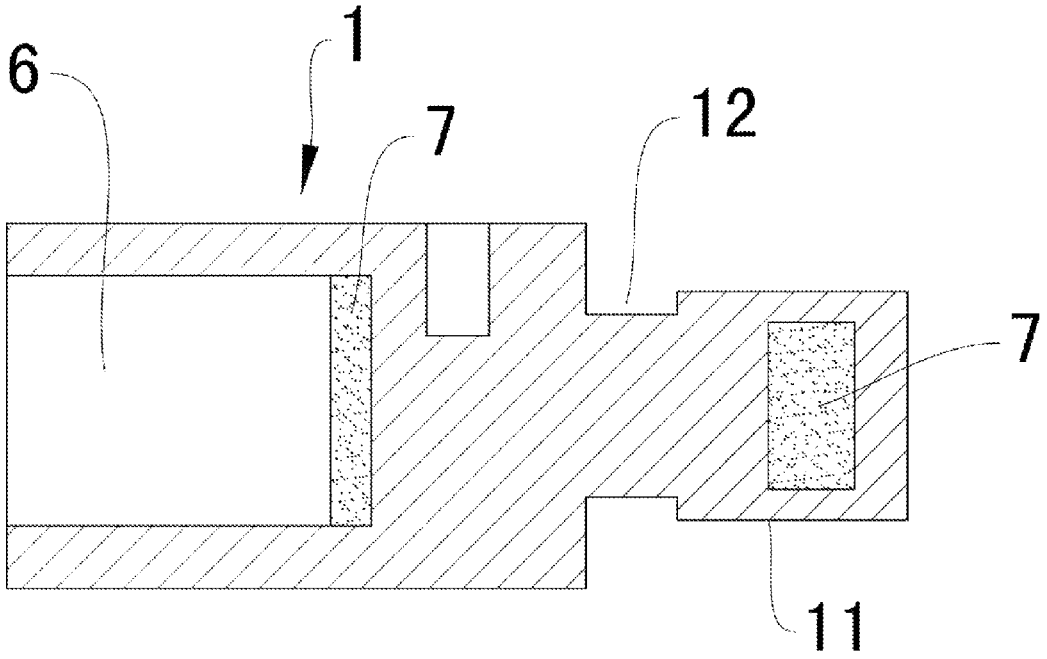
FIG. 11 illustrates a sectional structural view of the male connector of the second embodiment of the present invention.
Figure 12:
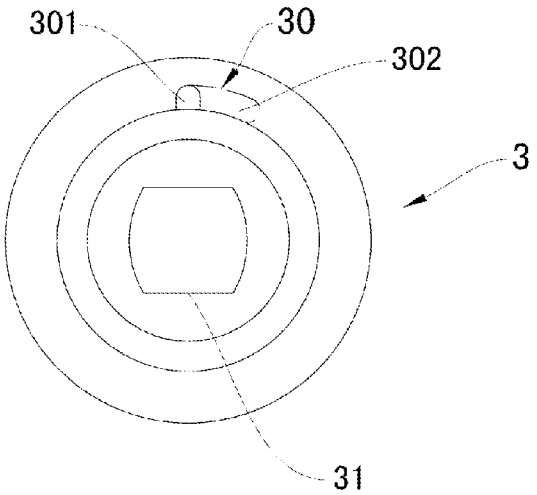
FIG. 12 illustrates a left structural view of the locking sleeve of the second embodiment of the present invention.
Figure 13:
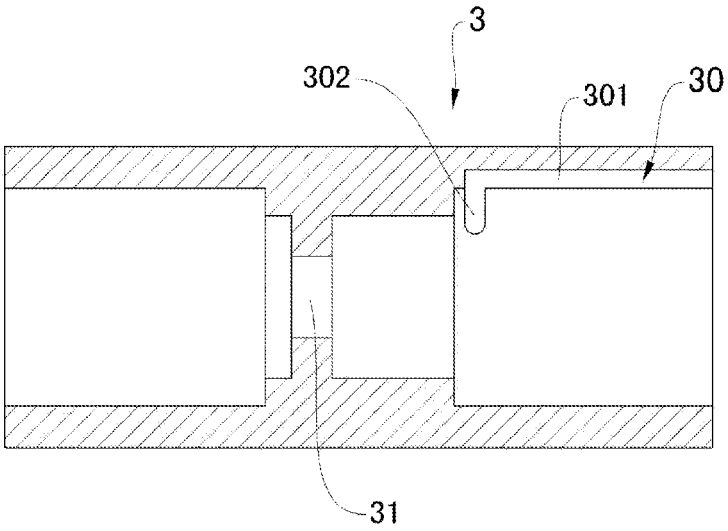
FIG. 13 illustrates a sectional structural view of the locking sleeve of the second embodiment of the present invention.

However, during actual production and implementation, the locking means among the female connector 2, the male connector 1 and the locking sleeve 3 and the positioning locking means among the locking cylinders 5, the chain connectors 4, the male connector 1 and the female connector 2 may be used in substitution or combination in a complete locking embodiment without any limitation. The embodiment shown in FIG. 9 is an example of such substitution and combination. As the operation principles of such embodiments of substitution and combination are basically the same as the aforementioned, the structures of such embodiments of substitution and combination are not repeated herein.

On the basis of the aforementioned, to facilitate alignment of the male connector 1 and the female connector 2 to enable more convenient and rapid assembly, as shown in FIGS. 1, 2, 9 and 14, the coupling portion 11 of the male connector 1 is further embedded with a magnetic block 7, and the coupling portion receiving cavity 21 of the female connector 2 is also embedded with a magnetic block 7 at bottom thereof. Certainly, the magnetic block 7 of the coupling portion 11 and the magnetic block of the coupling portion receiving cavity 21 have opposite polarities to achieve attraction of the opposites.

As shown in FIGS. 18, 12, 13 and 8, the locking slot 30 of the locking cylinders 5 or the locking sleeve 3 generally comprises a horizontal slot 301 and a vertical slot 302, and the vertical slot 302 and the horizontal slot 301 are interlinked at 90 degrees, so that when the male connector 1 and the female connector 2 are coupled with each other or when the locking cylinders 5 and the chain connectors are respectively coupled with each other, the pin 10 or the shaft 20 can first enter the horizontal slot 301 of the locking slot 30 during the coupling process, and when the locking sleeve 3 or the locking cylinders 5 is rotated, the pin 10 or the shaft can then embedded to the vertical slot 302 to achieve locking.

What is claimed is:

1. A jewelry clasp, comprising a male connector (1), a female connector (2), a locking sleeve (3), chain connectors (4) and locking cylinders (5); wherein the chain connectors (4) are connected to outer end surfaces of the male connector (1) and the female connector (2); the locking cylinders (5) are sleeved onto outer ends of the male connector (1) and the female connector (2); positioning locking means which allow the chain connectors (4), the male connector (1) and the female connector (2) to be reliably connected together are provided between the locking cylinders (5) and the chain connectors (4); the female connector (2) is sleeved into one end of the locking sleeve (3), and a locking means is provided between the female connector (2) and the one end of the locking sleeve (3); the male connector (1) is sleeved into another end of the locking sleeve (3); an inner end of the male connector (1) is coupled with an inner end of the female connector (2); a locking means is provided between the male connector (1) and the other end of the locking sleeve (3); rotation of the locking sleeve (3) once enables each of the locking means at the two ends of the locking sleeve (3) to reliably and securely lock and couple the male connector (1) and the female connector (2) together.

2. The jewelry clasp as in claim 1, wherein the outer end surfaces of male connector (1) and the female connector (2) are each provided with a coupling cavity (6), and the chain connectors (4) are sleeved into the coupling cavities (6).

3. The jewelry clasp as in claim 2, wherein the chain connectors (4) are embedded with magnetic blocks (7), and the coupling cavities (6) are embedded with magnetic blocks (7) at bottoms thereof.

4. The jewelry clasp as in claim 2, wherein the chain connectors (4) each has an outer appearance of a specific shape which is identical to a shape of each of the coupling cavities (6); an outer end surface of each of the locking cylinders (5) is provided with a positioning opening (8) for passage of the chain connector (4); an outer surface of each of the locking cylinders (5) is further provided with an elongated hole (9) for a pin (10) to pass through, and the pins (10) are secured on the male connector (1) and the female connector (2) respectively to enable the locking cylinders (5) to be sleeved onto the male connector (1) and the female connector (2) respectively; rotation of the locking cylinders (5) once causes the chain connectors (4) and the positioning openings (8) to offset with each other to position and lock the chain connectors (4) in the coupling cavities (6).

5. The jewelry clasp as in claim 2, wherein the chain connectors (4) each has an outer appearance of a specific shape which is identical to a shape of each of the coupling cavities (6); a shaft (20) is provided on an outer surface of each of the chain connectors (4); the locking cylinders (5) are each provided with a locking slot (30) and an elongated hole (9); the coupling cavities (6) of the male connector (1) and the female connector (2) each has a groove (40) at a cavity wall thereof; the pins (10) enter from the elongated holes (9) to be secured on the male connector (1) and the female connector (2) respectively to enable the locking cylinders (5) to be sleeved onto the male connector (1) and the female connector (2) respectively; the shafts (20) embed into the grooves (40) and the locking slots (30) respectively; rotation of the locking cylinders (5) once causes locking of the shafts (20) and the locking slots (30) to position and lock the chain connectors (4) into the coupling cavities (6).

6. The jewelry clasp as in claim 4 or 5, wherein the locking sleeve (3) is provided with a locking slot (30) in an inner wall at each of two ends of the locking sleeve (3); the pins (10) secured at the male connector (1) and the female connector (2) respectively have a length exceeding a thickness of the locking cylinders (5); the male connector (1) is provided with a coupling portion (11); the female connector (2) is provided with a coupling portion receiving cavity (21); the coupling portion (11) of the male connector (1) and the coupling portion receiving cavity (21) of the female connector (2) are coupled together, top ends of the pins (10) are embedded in the locking slots (30); rotation of the locking sleeve (3) once enables the pins (10) and the locking slots (30) to lock with each other to reliably and securely lock and couple the male connector (1) and the female connector (2) together.

7. The jewelry clasp as in claim 4 or 5, wherein the locking sleeve (3) is provided with a locking slot (30) in an inner wall at one end of the locking sleeve (3), an inner wall at another end of the locking sleeve (3) is provided with a positioning flange (31); the male connector (1) is provided with a coupling portion (11), and a positioning annular groove (12) is provided on the coupling portion (11); the female connector (2) is provided with a coupling portion receiving cavity (21); the pin (10) secured at the female connector (2) has a length exceeding a thickness of the locking cylinder (5); the coupling portion (11) of the male connector (1) passes through the positioning flange (31) to couple with the coupling portion receiving cavity (21) of the female connector (2); the positioning annular groove (12) on the coupling portion (11) embeds with the positioning flange (31); a top end of the pin (10) at the female connector (2) is embedded in the locking slot (30); rotation of the locking sleeve (3) once enables the pin (10) and the locking slot (30) to lock with each other and the positioning annular groove (12) and the positioning flange (31) to be embedded in offset, thereby reliably and securely locking and coupling the male connector (1) and the female connector (2) together.

8. The jewelry clasp as in claim 6, wherein the coupling portion (11) of the male connector (1) is further embedded with a magnetic block (7), and the coupling portion receiving cavity (21) of the female connector (2) is also embedded with a magnetic block (7) at a bottom thereof.

9. The jewelry clasp as in claim 7, wherein the coupling portion (11) of the male connector (1) is further embedded with a magnetic block (7), and the coupling portion receiving cavity (21) of the female connector (2) is also embedded with a magnetic block (7) at a bottom thereof.

10. The jewelry clasp as in claim 4 or 5, wherein the locking slot (30) generally comprises a horizontal slot (301) and a vertical slot (302), and the vertical slot (302) and the horizontal slot (301) are interlinked at 90 degrees.

* * * * *